US012089642B2

(12) United States Patent
Van Lancker et al.

(10) Patent No.: US 12,089,642 B2
(45) Date of Patent: Sep. 17, 2024

(54) HEATER ARRAY TO HEAT AEROSOL-GENERATING ARTICLE

(71) Applicant: PHILIP MORRIS PRODUCTS S.A., Neuchâtel (CH)

(72) Inventors: Pieter Van Lancker, Kortrijk (BE); Louis-Philippe Vancraeynest, Kortrijk (BE); Simon Desnerck, Kortrijk (BE)

(73) Assignee: PHILIP MORRIS PRODUCTS S.A., Neuchâtel (CH)

( * ) Notice: Subject to any disclaimer, the term of this patent is extended or adjusted under 35 U.S.C. 154(b) by 680 days.

(21) Appl. No.: 17/293,680

(22) PCT Filed: Nov. 12, 2019

(86) PCT No.: PCT/IB2019/059710
§ 371 (c)(1),
(2) Date: May 13, 2021

(87) PCT Pub. No.: WO2020/100034
PCT Pub. Date: May 22, 2020

(65) Prior Publication Data

US 2021/0401047 A1 Dec. 30, 2021

(30) Foreign Application Priority Data

Nov. 13, 2018 (EP) ..... 18206022

(51) Int. Cl.
*A24F 40/46* (2020.01)
*A24F 40/51* (2020.01)
(Continued)

(52) U.S. Cl.
CPC ..... *A24F 40/46* (2020.01); *A24F 40/51* (2020.01); *A24F 40/53* (2020.01); *A24F 40/57* (2020.01)

(58) Field of Classification Search
CPC ..... A24D 1/20; A24D 1/002; A24F 40/10; A24F 40/20; A24F 40/42; A24F 40/46; A24F 40/50; A24F 40/30
See application file for complete search history.

(56) References Cited

U.S. PATENT DOCUMENTS 7,540,286 B2 * 6/2009 Cross ..... A61M 16/1075 128/203.26
10,939,707 B2 * 3/2021 Hejazi ..... A24F 40/46
(Continued)

FOREIGN PATENT DOCUMENTS

JP 2012-513750 A 6/2012
JP 2016-178937 A 10/2016
(Continued)

OTHER PUBLICATIONS

Extended European Search Report for EP Application No. 18206022.8, issued by the European Patent Office on Jun. 14, 2019; 7 pgs.
(Continued)

*Primary Examiner* — Oscar C Jimenez
(74) *Attorney, Agent, or Firm* — Mueting Raasch Group

(57) ABSTRACT

An aerosol-generating device (100) including a heater array (120) and methods for use therewith may generate aerosol using aerosol-generating articles (130). The heater array includes a plurality of heating elements (122) arranged about an aerosol-generating device to direct heat to an aerosol-generating articles coupled thereto. At least one property of the aerosol-generating article may be identified and the aerosol-generating article may be heated using the heater array based on the identified at least one property.

26 Claims, 9 Drawing Sheets

(51) Int. Cl.
*A24F 40/53* (2020.01)
*A24F 40/57* (2020.01)

(56) References Cited

U.S. PATENT DOCUMENTS

| | | | | |
|---|---|---|---|---|
| 2014/0060554 | A1 | 3/2014 | Collett et al. | |
| 2014/0064715 | A1 | 3/2014 | Greim et al. | |
| 2015/0053221 | A1* | 2/2015 | Asghar-Sheikh | A24F 40/40 131/329 |
| 2015/0181935 | A1 | 7/2015 | Lyubomirskiy et al. | |
| 2016/0262454 | A1* | 9/2016 | Sears | B01F 23/2133 |
| 2018/0080559 | A1* | 3/2018 | Li | F16J 15/14 |
| 2018/0116285 | A1* | 5/2018 | Polloni | A24F 40/70 |
| 2018/0116286 | A1* | 5/2018 | Polloni | A24F 40/70 |
| 2019/0289908 | A1* | 9/2019 | Worm | A61M 11/042 |
| 2019/0350260 | A1* | 11/2019 | Di Marco | A24F 40/30 |
| 2021/0227892 | A1* | 7/2021 | Leah | A24F 40/30 |
| 2022/0225682 | A1* | 7/2022 | Abi Aoun | A24F 40/20 |
| 2023/0000171 | A1* | 1/2023 | Kabirat | A24F 40/485 |

FOREIGN PATENT DOCUMENTS

| | | | |
|---|---|---|---|
| JP | 2017-522872 | A | 8/2017 |
| WO | WO 2010/073122 | A1 | 7/2010 |
| WO | WO 2011/079933 | A1 | 7/2011 |
| WO | WO 2013/022936 | A1 | 2/2013 |
| WO | WO 2013/034458 | A1 | 3/2013 |
| WO | WO 2014/064715 | A2 | 5/2014 |
| WO | WO 2015/062983 | A2 | 5/2015 |
| WO | WO 2016/005530 | A1 | 1/2016 |
| WO | WO 2017/178931 | A1 | 10/2017 |
| WO | WO 2017/186455 | A1 | 11/2017 |

OTHER PUBLICATIONS

International Search Report and Written Opinion for PCT/IB2019/059710, issued by the European Patent Office on Jan. 15, 2020; 14 pgs.

European Office Action issued for EP 19805757.2 by the European Patent Office on Dec. 8, 2022; 5 pgs.

Chinese Office Action for CN 201980069121.2, issued by the Chinese Patent Office on Dec. 4, 2023, 15 pgs. Including English translation.

Japanese Office Action for JP 2021-520361, issued by the Japanese Patent office on Dec. 11, 2023; 10 pgs. including English translation.

* cited by examiner

HEATER ARRAY TO HEAT AEROSOL-GENERATING ARTICLE

This application is the § 371 U.S. National Stage of International Application No. PCT/IB2019/059710, filed 12 Nov. 2019, which claims the benefit of European Application No. 18206022.8, filed 13 Nov. 2018, the disclosures of which are incorporated by reference herein in their entireties.

This invention relates to devices including a heater array for use with aerosol-generating articles, and methods for use thereof. The heater array may include a plurality of heating elements each separately or collaboratively used to heat an aerosol-generating article in a variety of ways. The devices may execute and the methods may include identifying at least one property of an aerosol-generating article and heating the aerosol-generating article using the heater array based on the identified at least one property of the aerosol-generating article.

Preferably, such devices and methods are configured to sufficiently heat aerosol-generating articles to cause generation of an aerosol, without combusting the aerosol-generating articles. These are known as "heat-not-burn" devices and are often used for consumption of tobacco or tobacco-based products. For instance, these devices may heat tobacco-based aerosol-generating articles in order to release aerosols which contain nicotine and aromatic substances.

Generally, two types of heating elements may be distinguished based on the arrangement of the heating element in relation to the aerosol-generating article or consumable, e.g., internal heaters and external heaters. An internal heater is contained within the aerosol-generating article during use and heats the aerosol-generating article from within. An external heater is typically arranged around the aerosol-generating article, heating it from the outside in.

One illustrative internal heating, heat-not-burn, device heats tobacco-containing articles that resemble conventional cigarettes. Such heating device includes a heating blade that pierces the tobacco-containing article to contact and heat the tobacco substrate. A user may draw on a mouth end of the device to cause aerosol flow through the tobacco-containing article for inhalation. Because the substrate is not combusted, by-products of combustion and pyrolysis are not included in the aerosol, and thus are not delivered to the user for inhalation All aerosol generating devices, both with internal and external heaters require a certain time to heat up the aerosol-generating article, or consumable, to the required aerosol-generating temperature. During this time, the user cannot use the device and needs to wait. One known solution in the field described in PCT Patent Application Pub. No. WO2015062983 comprises an external heating element with multiple, longitudinally arranged sections. At least one of these sections is smaller than the others, and therefore, may allow it to heat up a smaller portion of the aerosol-generating article faster than the other sections, reducing the initial heat up time.

Another challenge in aerosol-generating devices is the heating of the consumable material of the aerosol-generating article throughout the entire volume. Usually, the aerosol-generating article has a cylindrical shape and is heated either from within the center (e.g., using an internal heating element) or the outer surface (e.g., using an external heating element). In both cases, heat needs to penetrate through the material to a distance equal to half of the diameter of the consumable. Additionally, certain portions of the aerosol-generating article may need to be heated at different times than other portions to achieve effective, sustainable aerosol generation.

In order to achieve this heat penetration and heat the region of the consumable material of the aerosol-generating article furthest away from the heating element to the aerosol generating temperature, the material closer to the heating element is usually heated longer and to a higher temperature than necessary or optimal. Since different volatiles may be released at different temperatures, heating to higher temperatures may release unwanted volatiles and may alter the taste of the aerosol. One known solution in the field described in PCT Patent Application Pub. No. WO2015062983 uses a multiple-component aerosol-generating device with multiple heating regions to heat said components of an aerosol-generating article to different specific temperatures.

Other disclosures such as described in U.S. Pat. App. Pub. No. 2015/181935 may use temperature-sensitive heating elements having an altering shape to cause progressive heating of the aerosol-generating article or consumable (e.g., smokable material). This may ensure a fresh portion of the aerosol-generating article is heated at any time, but also keeps heating the already consumed portion of the aerosol-generating article, leading to unnecessary energy consumption.

Therefore, such aerosol-generating devices may provide a less desirable experience for users because the aerosol-generating devices may not operate most effectively or efficiently when generating aerosol from aerosol-generating articles. Further, such aerosol-generating devices may waste one or more portions of aerosol-generating articles due to ineffective or inefficient heating. Additionally, such aerosol-generating devices may overheat one or more portions of the aerosol-generating articles when attempting to heat the entire aerosol-generating articles, which may release undesired aerosols and may waste energy.

It would be desirable to produce a device that can heat an aerosol generating article in highly-configurable, efficient manner. It would also be desirable to heat the aerosol-generating article without substantial waste. Further, it would desirable to heat aerosol-generating articles evenly without overheating some portions of the aerosol-generating articles and underheating other portions of the aerosol-generating articles.

One object of examples of the invention is to provide highly-configurable, or highly-customizable, heating of an aerosol-generating article. Another object of examples of the invention is to maintain consistent heat delivery across the entire aerosol-generating article.

Another object of examples of the invention is to increase aerosol generation or production, increase aerosol generation efficiency, and adjust (e.g., including maximize) flavour profile provide of aerosol generated for different aerosol-generating articles.

In one aspect, the illustrative devices and methods provide a heating system for an aerosol generating heat-not-burn device. The heating system consists of an array of individually addressable heating elements, configured to heat different sections of the consumable consecutively during the entire session. This allows for a faster heat up time and aerosol release from fresh material at all times, avoiding overheating of material or unnecessary energy use.

In various aspects, aerosol-generating device may include a housing defining a cavity to receive an aerosol-generating article and extending along a cavity axis and a heater array disposed in the cavity. The heater array comprises a plurality of heating elements operable to heat an aerosol-generating article positioned within the cavity. The plurality of heating elements may include at least three heating elements. In one aspect, two or more heating elements of the plurality of heating elements are positioned within a plane orthogonal to the cavity axis, and two or more heating elements of the plurality of heating elements are positioned in different positions along the cavity axis so as to not lie in a plane orthogonal to the cavity axis. In this aspect, at least two heating elements would be configured to heat the same section of an aerosol-generating article along the cavity axis and at least one heating element would be configured to heat a different section of the aerosol-generating article located at a different location along the cavity axis In various aspects, the illustrative heater array, or heating system, may include at least three separate heating elements that may be controlled in at least two separate groups, each group including at least one heating element. Each heating element may be, but are not limited to: a resistive, infrared, inductive, thermoelectric or photonic heating element.

The invention described herein may be able to provide highly-configurable, or highly-customizable, heating of aerosol-generating articles through the use of such heater array. For example, each heating element may be selectively configured to heat small regions of aerosol-generating articles so as to increase aerosol generation or production, increase aerosol generation efficiency, adjust (e.g., including maximize) flavour profile provide of aerosol generated, and maintain consistent heat delivery across the entire aerosol-generating article. Additionally, the invention described herein may modify, customize, or optimize heating operating characteristics, or parameters, and heating time periods and locations of aerosol-generating articles in accordance with the identity of the aerosol-generating articles so as to increase aerosol generation or production, increase aerosol generation efficiency, and adjust (e.g., including maximize) flavour profile provide of aerosol generated.

In one embodiment, the heating elements include an electrically-resistive material. Suitable electrically-resistive materials include but are not limited to: semiconductors such as doped ceramics, electrically-conductive ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminum-, titanium-, zirconium-, hafnium-, niobium-, molybdenum-, tantalum-, tungsten-, tin-, gallium-, manganese-, and iron-containing alloys, and super-alloys based on nickel, iron, cobalt, stainless steel, and iron-manganese-aluminum based alloys. In composite materials, the electrically-resistive material may optionally be embedded in, encapsulated or coated with an insulating material or vice-versa, depending on the kinetics of energy transfer and the external physiochemical properties required.

In various aspects, the aerosol-generating device further includes a controller comprising one or more processors and operably coupled to the heater array to select which of the plurality of heating elements to heat an aerosol-generating article. In other words, in various aspects, the implementation of the addressable heater array utilizes a controller to control the individual elements of the heater array. The controller may be configured to identify at least one property of the aerosol-generating article, and then heat the aerosol-generating article using the heater array based on the identified at least one property of the aerosol-generating article.

Further, methods of heating an aerosol-generating article using a heater array are contemplated by this disclosure. In one aspect, preferably, the method comprises positioning an aerosol-generating article within a cavity of a housing extending along a cavity axis and identifying at least one property of the aerosol-generating article positioned within the cavity. The method further comprises heating the aerosol-generating article using a heater array disposed in the cavity based on the identified at least one property of the aerosol-generating article. In at least one embodiment, heating an aerosol-generating article using a heater array may include using at least two heating elements positioned within a first plane orthogonal to the cavity axis to heat the aerosol-generating article while not heating the aerosol-generating article with at least one other heating element of the plurality of heating elements.

In various aspects, preferably, the plurality of heating elements are arranged in a grid defining a plurality of rows of heating elements and a plurality of columns of heating elements. The heating elements of each row are positioned within a plane orthogonal to the cavity axis that is different from the other rows, and the heating elements of each different column are positioned along a different axis parallel to the cavity axis. In other words, the plurality of heating elements may be described as being a plurality of heat "pixels" spaced about an area.

Various aspects of the devices and method according to the present invention may provide one or more advantages relative to currently-available aerosol-generating devices and methods associated therewith. The illustrative devices and methods may provide users a more desirable experience since the consumable may be more efficiently and effectively used to generate aerosol from aerosol-generating articles. Further, the illustrative aerosol-generating devices and methods may modify operating characteristics, or parameters, of the heater array based on the identity of the aerosol-generating article to efficiently and effectively produce aerosol with the particularly identified aerosol-generating article. The efficient and effective production of aerosol may improve the users experience because the aerosol may be optimally produced thereby providing a satisfying aerosol delivery experience.

Further, the illustrative devices and methods may provide the ability to more completely use the aerosol-generating articles to minimize waste of aerosol-generating substrate of the aerosol-generating article. Additionally, the highly-configurable heat delivery aerosol-generating articles provided by the illustrative devices and methods may be used to deliver a consistent and configurable flavour profile. The illustrative devices and methods may provide less areas, or regions, of the aerosol-generating article being overheated thereby reducing the release of undesirable aerosols.

The illustrative devices and methods may allow for a faster "heat up" time of an aerosol-generating article, or consumable, to the required temperature for aerosol generation. The illustrative devices and methods may enable aerosol release from fresh material at all times while avoiding overheating of material to achieve heat penetration. These properties may result in a better aroma in the aerosol and therefore a better user experience.

By avoiding overheating, the illustrative devices and methods may use less energy to release the aerosols and the heat-not-burn device may become more energy efficient.

Increased efficiency may result in a longer use of the device on one charge and improved battery lifetime because of lower loads.

As used herein, an "aerosol-producing substrate" is any substrate capable of releasing, upon heating, volatile compounds, which may form an aerosol. The aerosols generated from aerosol-producing substrates according to the present disclosure may be visible or invisible and may include vapours (for example, fine particles of substances, which are in a gaseous state, that are ordinarily liquid or solid at room temperature) as well as gases and liquid droplets of condensed vapours.

As used herein, an "aerosol-generating article" is any disposable product capable of including (e.g., holding, containing, having, or storing) aerosol-producing substrate and capable of removably interfacing, or docking, with an aerosol-generating device so as to allow the aerosol-generating device to generate aerosol from the aerosol-producing substrate. The aerosol-generating article may be a solid containing aerosol-producing substrate.

As used herein, an "aerosol-generating device" is any device configured to use, or utilize, an aerosol-producing article that releases volatile compounds to form an aerosol that may be inhaled by a user. The aerosol-generating device may be interfaced with an aerosol-generating article comprising the aerosol-producing substrate.

As used herein, a "heating element" is any device, apparatus, or portion thereof configured to provide heat, or heat energy, to an aerosol-generating article containing an aerosol-producing substrate to release volatile compounds from the aerosol-generating article to form an aerosol that may be inhaled by a user.

As used herein, a "heater array" is a plurality of heating elements arranged in a particular way, within, or about an aerosol-generating device to provide, or deliver, heat to an aerosol-generating article to generate aerosol. The heater array may include at least three heating elements.

As used herein, the terms "controller" and "processor" refer to any device or apparatus capable of providing computing capabilities and control capabilities suitable, or configurable to perform the methods, process, and techniques described herein such as, e.g., microprocessors, digital signal processors (DSP), application specific integrated circuits (ASIC), field-programmable gate arrays (FPGA), equivalent discrete or integrated logic circuitry, or any combination thereof and of providing suitable data storage capabilities that includes any medium (e.g., volatile or non-volatile memory, a CD-ROM, or magnetic recordable medium such as a disk or tape) containing digital bits (e.g., encoded in binary or trinary) that may be readable and writeable.

The present invention relates to aerosol-generating devices, and methods performable thereby, that are configured to use aerosol-generating articles containing aerosol-producing substrates (e.g., comprising nicotine-containing material) to generate aerosol containing particulate matter such as nicotine. As described herein, the aerosol-generating articles may include liquids or solids containing the aerosol-producing substrate. For example, the aerosol-generating article could be a "stick" (for instance, a stick with tobacco cast leaf).

To generate aerosol from the aerosol-generating article, heat is delivered to the aerosol-generating article, which is described as a "heat-not-burn" process. The heat is generated and delivered to the aerosol-generating article by the aerosol-generating devices when the aerosol-generating article is received or otherwise operably coupled to the aerosol-generating devices.

An illustrative aerosol-generating device includes a housing or body that may be configured to hold, or contain, the components of the aerosol-generating device and defines a cavity for receiving an aerosol-generating article. The cavity extends, or is oriented, along an axis referred to as a cavity axis. The cavity may be generally defined as any structure configured to mate with an aerosol-generating article. Preferably, the cavity defines an interior space that encloses the aerosol-generating article so as to provide a chamber for the generation of aerosol for deliver to a user. The illustrative heater arrays described herein are configured to be coupled to the housing and positioned so as to generate aerosol in the cavity. In one embodiment, the heater arrays are positioned in, or within, the cavity to delivered heat to an aerosol-generating article. For instance, the illustrative heater arrays may be positioned on one or more surfaces of the cavity.

The housing may further define at least one inlet extending into the cavity to intake air and at least one outlet extending into the cavity to discharge air. An airflow path may be defined from the at least one inlet to the at least one outlet extending along the cavity axis. When air is inhaled by a user of the aerosol-generating device, the air may enter the at least one inlet, pass through the cavity (and aerosol-generating article contained therein), and leave the cavity through the at least one outlet to the user along the airflow path. The airflow path does not necessarily need to be straight. The airflow path may follow one or more curves or bends.

The cavity may be or define a plurality of different shapes and sizes so as to be configurable to receive aerosol-generating articles having a plurality of different shapes and sizes. For example, the cavity may be a tube (for example, defining a tubular shape) extending along the cavity axis for receiving tubular, cylindrical, or "stick"-shaped aerosol-generating articles. The tube defines an inner cylindrical surface that "faces" the aerosol-generating article located therein. In use, the inner cylindrical surface may contact, or may be adjacent, the aerosol-generating article located therein when configured to heat the aerosol-generating article.

In other words, in this illustrative embodiment where the aerosol-generating article or has a cylindrical shape, the heater array may also have a tubular shape with an inner diameter that may be approximately equal to the outer diameter of the aerosol-generating article. In another illustrative embodiment, the aerosol-generating article and heater array may have matching tubular shapes. Either of the two may be outside the other. In other words, the heater array may be positioned facing radially away from a central axis of the tube (e.g., to deliver heat radially away from the central axis) and the aerosol-generating article may be positioned outside of the heater array or the heater array may be positioned facing towards a central axis of the tube (e.g., to deliver heat towards the central axis) and the aerosol-generating article may be positioned inside of the heater array.

The cavity may be a box or may be box-shaped extending along the cavity axis for receiving flat, thin box-shaped aerosol-generating articles. For instance, the housing may define at least one planar surface. The housing may include a hinged door that swings down around the aerosol-generating article when the aerosol-generating article is located between the hinged door and the at least one planar surface. Further, the hinged-door may define another planar surface, and thus, the aerosol-generating article may be pinched between the at least one planar surface of the housing and the planar surface of the hinged door. In other words, the housing may further include two planar surfaces positionable opposite each other when configured to heat an aerosol-generating article located in the cavity. In one aspect, one or more planar surfaces of the housing contact, or are adjacent to, the aerosol-generating article located therein when configured to heat the aerosol-generating article. One or more heater arrays may be utilized in such designs. For example, one heater array may be positioned on one planar surface and another, opposite planar surface may not include a heater array. Further, for example, each of two planar surfaces opposing each other may include a heater array resulting in two opposing heater arrays on either side of an aerosol-generating article.

In other words, the aerosol-generating article may be a predominantly flat shape, and at least one side of the predominantly flat-shaped aerosol-generating article may be held against a heater array. Additionally, the flat-shaped aerosol-generating article may also be described as being box-like or rectangular having, or defining a width that is less than its length and a substantially flat thickness when compared to the length or width. A flat-shaped aerosol-generating article may be described as having an optimized surface to volume ratio, allowing for good heat transfer while reducing the distance the heat needs to travel through the material of the aerosol-generating article to heat it.

Still further, for example, the cavity may be a cone or truncated cone extending along the cavity axis and defining a conical inner or conical outer surface. The cone or truncated cone defines an inner or outer conical surface that "faces" the aerosol-generating article located therein. In one aspect, the inner or outer conical surface contacts, or is adjacent, the aerosol-generating article located therein when configured to heat the aerosol-generating article.

In other words, in this more preferred embodiment, the aerosol-generating article is generally-shaped as a truncated or full cone or another shape. The heater array in this illustrative embodiment is shaped as a full or truncated cone or drafted shape matching the cone shape of the aerosol-generating article. In this case, the aerosol-generating article, or consumable, and heater array may always be matched to have optimal contact and still be removable with minimal effort.

The heater array may be shaped to conform to the shape of the aerosol-generating article, or consumable, as close as possible. This may increase the contact area between the heater array and aerosol-generating article or consumable, leading to improved heat conduction and therefore faster and more efficient heating of the aerosol-generating article or consumable.

To heat an aerosol-generating article when the aerosol-generating article is positioned within the cavity of the aerosol-generating device, the aerosol-generating device include a heater array. The heater array includes a plurality of heating elements. Each of the heating elements may be configured to deliver heat, or heat energy, to a different region, or portion of the aerosol-generating article when positioned in the cavity as will be described further herein.

The heater array may include between 3 heating elements and about 250 heating elements. Preferably, the heater array includes about 15 heating elements to about 80 heating elements. The heating elements are preferably arranged about the cavity of the aerosol-generating device so as to provide, or deliver, heat to various positions, various distances along the cavity axis, and various locations or regions about the cavity at the same position along the cavity axis. Two or more heating elements of the plurality of heating elements are positioned within a plane orthogonal to the cavity axis and two or more heating elements of the plurality of heating elements are positioned in different positions along the cavity axis so as to not lie in a plane orthogonal to the cavity axis. In other words, at least two heating elements are positioned at the same distance along the cavity axis and at least two heating elements are positioned at different distances along the cavity axis.

In one aspect, the heating elements of the heater array may be arranged in a grid of rows and columns. The rows of heating elements may be positioned at the same, or approximately the same, distance along the cavity axis, and the columns of heating element may be positioned along the cavity axis at different distances but still be aligned along a line or axis that is parallel to the cavity axis. The grid of heating elements of the heater array may be wrapped about, or conforming to, one or more surfaces of the cavity of the aerosol-generating device. In this way, although the grid of the heater array may be described herein using two-dimensional terms, it is to be understood that the grid may be positioned on surfaces defining three-dimensional shapes. For example, in the illustrative embodiment wherein the cavity is a cylinder, the grid of the heating elements may be wrapped about the outer or inner surface of the cylinder where rows are aligned perpendicular to the axis of the cylinder about the cylinder surface, and the columns extend perpendicular to the axis about the cylinder surface.

In these ways, the heater array may be described as providing broad coverage about the cavity so as to provide heat to a plurality of different but potentially overlapping regions or portions of an aerosol-generating article positioned in the cavity.

When the cavity is tubular, the plurality of heating elements are positioned on the cylindrical inner surface to heat an aerosol-generating article positioned within the cavity, and two or more heating elements are positioned within a plane orthogonal to the cavity axis and circumferentially about the cylindrical inner surface. When the cavity is defined by at least two planar surfaces, zero or more heating elements are positioned on one of the at least two planar surfaces and a plurality of heating elements are positioned on the other of the at least two planar surfaces so as to "sandwich" an aerosol-generating article located therebetween. In another aspect, only one two planar surfaces may include heating elements. When the cavity is conical, the plurality of heating elements are positioned on the conical inner or outer surface to heat an aerosol-generating article positioned within the cavity, and the two or more heating elements are positioned within a plane orthogonal to the axis and positioned circumferentially about the conical inner or outer surface.

The aerosol-generating device may include a heating circuitry. The aerosol-generating device may include a power source. The heating circuitry is operably coupled to the heater array to provide power from the power source to the heating elements such that each of the heating elements of the heater array may provide, or deliver, heat to an aerosol-generating article. The heating circuitry may be configured in a variety of different ways such that the heater array is configurable in a variety of different ways.

In one aspect, the heating circuitry may allow each of the heating elements to be individually configurable in at least two states: be "turned on," or energized, so as to provide heat to the aerosol-generating article; or to be "turned off," or not energized, so as to not provide heat to the aerosol-generating article. In other words, the heating circuitry may be configured to allow each of the heating elements to be controlled independently of the other heating elements. In this aspect, each of the plurality of heating elements may be directly operably coupled to the power source via a pair of conductors (e.g., wires or traces) so as to individually control each of the heating elements by coupling or uncoupling each of the heating elements from the power source.

Further, in one aspect, the heating circuitry is operably coupled to the heater array to provide a plurality of groups of heating elements to allow each group of the plurality of groups to heat an aerosol-generating article individually or at the same time as other heating elements, and each heating element of each group heats an aerosol-generating article at the same time as other heating elements of the group. In other words, the heating circuitry may be configured to activate, or "turn on," more than one heating element at a time in sets of heating elements referred to as "groups" or "zones." For instance, one or more groups or zones of heating elements, each group or zone comprising at least two heating elements, may be "turned on" at the same time. In this aspect, each of the plurality of heating elements of a group may be directly operably coupled to the power source in parallel such that a single pair of conductors (e.g., wires or traces) operably couples the group to the power source.

Additionally, the heating circuit may be configured to provide electricity to each of the heating elements or group of heating elements for a selected amount of time using, e.g., a multiplexing scheme. More specifically, in one aspect, the heating circuitry is operably coupled to the heater array to allow each of the plurality of heating elements to heat an aerosol-generating article individually or at the same time as other heating elements using a time-division pulse drive based on an identified at least one property of the aerosol-generating article. In this aspect, all heating elements may be arranged and wired (e.g., wires or traces) in a matrix format, and a voltage may be applied at the intersections of specific vertical signal electrodes and specific horizontal scanning electrodes to use heating elements individually or at the same time.

The power source of the aerosol-generating device may, preferably, be internal to the housing. The aerosol-generating device may comprise any suitable power source. For example, a power source of an aerosol-generating device may be a battery, a set of batteries, or any other power source. The batteries may be rechargeable, as well as removable and replaceable. Any suitable battery may be used.

The aerosol-generating device may include a controller comprising one or more processors (for example, microprocessors). The one or more processors may operate with associated data storage, or memory, for access to processing programs or routines and one or more types of data that may be employed to carry out the illustrative methods. For example, processing programs or routines stored in data storage may include programs or routines for controlling the heater array, individually controlling each of the heating elements of the heater array, implementing heating programs or schemes using the heater array, analyzing or identifying aerosol-generating articles, recalling one or more properties of identified aerosol-generating articles, recalling one or more heating programs associated with one or more properties of identified aerosol-generating articles, controlling amounts of time heating elements should be energized, matrix mathematics, standardization algorithms, comparison algorithms, or any other processing used to implement the one or more illustrative methods and processes described herein. The data storage, or memory, may be further configured to store data related to one or more types, sizes, shapes, content, age, brand, and density of aerosol-generating articles, one or more other properties of aerosol-generating articles, one or more heating processes or schemes for using the heater array to heating various aerosol-generating articles, aerosol production or generation parameters related to the one or more types of aerosol-producing articles and substrates such as power values and time values, data and formulas related to the generation of particulate matter using the aerosol-generating articles or substrates, and any other data or formulas necessary to perform the processes and methods described herein.

In one or more aspects, the aerosol-generating device may be described as being implemented using one or more computer programs executed on one or more programmable processors that include processing capabilities (for example, microcontrollers or programmable logic devices), data storage (for example, volatile or non-volatile memory or storage elements), input devices, and output devices. Program code, or logic, described herein may be applied to input data to perform functionality described herein and generate desired output information. The output information may be applied as input to one or more other devices or processes as described herein or as would be applied in a known fashion.

The computer program products used to implement the processes described herein may be provided using any programmable language, for example, a high-level procedural or object orientated programming language that is suitable for communicating with a computer system. Any such program products may, for example, be stored on any suitable device, for example, a storage media, readable by a general or special purpose program, controller apparatus for configuring and operating the computer when the suitable device is read for performing the procedures described herein. In other words, at least in one embodiment, the aerosol-generating device may be implemented using a non-transitory computer readable storage medium, configured with a computer program, where the storage medium so configured causes the computer to operate in a specific and predefined manner to perform functions described herein.

The exact configuration of the controller of the aerosol-generating device is not limiting and essentially any device capable of providing suitable computing capabilities and control capabilities to implement the illustrative methods described herein may be used. In view of the above, it will be readily apparent that the functionality as described in one or more embodiments according to the present invention may be implemented in any manner as would be known to one skilled in the art. As such, the computer language, the controller, or any other software/hardware which is to be used to implement the processes described herein shall not be limiting on the scope of the systems, processes, or programs (for example, the functionality provided by such processes or programs) described herein. The methods and processes described in this disclosure, including those attributed to the systems, or various constituent components, may be implemented, at least in part, in hardware, software, firmware, or any combination thereof. For example, various aspects of the techniques may be implemented within one or more processors, including one or more microprocessors, DSPs, ASICs, FPGAs, CPLDs, microcontrollers, or any other equivalent integrated or discrete logic circuitry, as well as any combinations of such components. When implemented in software, the functionality ascribed to the systems, devices, and methods described in this disclosure may be embodied as instructions on a computer-readable medium such as RAM, ROM, NVRAM, EEPROM, FLASH memory, magnetic data storage media, optical data storage media, or the like. The instructions may be executed by one or more processors to support one or more aspects of the functionality.

The controller of the aerosol-generating device may be operatively coupled to the power source and the heating circuitry so as to control the heater array. Thus, the controller may use the heating circuitry and the power source to energize ("turn on") or not energize ("turn off") each of the heating elements of the heater array. Depending on the configuration of the heating circuitry, the controller may individually control each of the heating elements independently or may control two or more heating elements at the same time as a group independently from other heating elements. Additionally, the controller may adjust the time, or period of time, each of the heating elements may be energized or active ("turned on") to perform various heating patterns, processes, or schemes for generating aerosol using various aerosol-generating articles.

In one aspect, the controller may be described as being operably coupled to the heater array to select which of the plurality of heating elements is used to heat an aerosol-generating article. In other words, each of the heating elements may be addressable by the controller. Further, the controller may be configured to execute heating an aerosol-generating article using at least two heating elements positioned within a first plane orthogonal to the cavity axis to heat the aerosol-generating article while not heating the aerosol-generating article with at least one other heating element of the plurality of heating elements. In other words, at least two heating elements that a positioned in a row orthogonal to an airflow path within the aerosol-generating device may be "turned on" to heat a portion or region of aerosol-generating article.

The controller may activate different heating elements over a period time to efficiently and effectively generate aerosol from the aerosol-generating article. The aerosol-generating article may extend from a proximal, or upstream, end to a distal, or downstream, end. For example, the controller may use one or more heating elements to heat a proximal end of an aerosol-generating article and, over time, the controller may use heating elements located further away from the proximal end and closer to the distal end of the aerosol-generating article than initially used so as to linearly move the heat along an aerosol-generating article. Other examples may utilize different movement of heat delivery using the heater array. In various aspects, the controller is further configured to heat the aerosol-generating article according to one or more propagation patterns using selected heating elements. The propagation patterns may include one or more of linear movement, radial movement, angular movement, extending movement, expanding movement, shrinking movement, and random movement. Such movement patterns may be described in reference to the heater array defining a grid of heating elements. For example, the plurality of heating elements may be arranged in a grid defining a plurality of rows of heating elements and a plurality of columns of heating elements. The heating elements of each row are positioned within a plane orthogonal to the cavity axis that is different from the other rows, and the heating elements of each different column are positioned along a different axis parallel to the cavity axis. The controller may be further configured heat the aerosol-generating article using a selected group or zone of heating elements which may move across the grid according to one or more propagation patterns provided by the controller. The selected group or zone may define one or more of a line, curved line, crossed lines, a zig-zag, a helix, a square, a perimeter of a square, a rectangle, a circle, a triangle, an octagon, and a star about the grid. In one aspect and preferably, one or both of the propagation pattern and the selected zone or group may be used based on an identified at least one property of the aerosol-generating article, which may result in effective and efficient aerosol production from the aerosol-generating article.

The plurality of heating elements may be arranged in a plurality of rows of heating elements. Each row of heating elements comprises two or more heating elements, and the two or more heating elements of each row are positioned within a plane orthogonal to the axis that is different from the other rows. Further, the controller may be further configured to heat the aerosol-generating article using the two or more heating elements of only one row at the same time until each of the plurality of rows has heated the aerosol-generating article. The aerosol-generating article may be heated using at least two or more heating elements of only two rows at the same time until each of the plurality of rows has heated the aerosol-generating article. The temperature of a first row of the two rows may be greater than the temperature of the second row of the two rows when heating the aerosol-generating article with the two rows at the same time. In these ways, the aerosol-generating article may be efficiently and effectively consumed while also potentially limiting the amount of wasted substrate.

In one aspect, preferably, the controller may be configured to initially heat the aerosol-generating article using a first number, or amount, of heating elements of the plurality of heating elements and subsequently heat the aerosol-generating article using a second number, or amount, of heating elements of the plurality of heating elements where the second number is greater than the first number. In other words, the aerosol-generating device may heat one portion of the aerosol-generating article using a number of heating elements, and then heat another, different portion of the aerosol-generating article using another, different, number of heating elements that is more than initially used. In another aspect, the first number is equal to the first number. In this way, the controller may provide a heating program or process that utilizes two or more amounts, or numbers, of heating elements to heat the aerosol-generating article, which may result in effective and efficient aerosol production while also potentially minimizing waste.

Thus, each heating element in the array may be controlled separately using various different heating programs or processes within the same device. In a preferred heating program, the initial heating zone or group, consisting of one or more heating elements, is smaller than the heating zones in the subsequent steps in the program. This smaller initial heating zone allows for faster heating, since the available electrical power may be concentrated in a smaller area. Therefore, initial heat up of the material will be faster, reducing the wait time for the user.

Heating zones or groups in the subsequent steps in the heating program may be adjacent or overlapping with each other. Because of heat conduction through the consumable material, heat from a certain heated section will partially heat adjacent sections of material. Heating this partially pre-heated section to the aerosol generating temperature may use less energy, improving energy efficiency and shortening the time to heat this section to the required temperature.

Dependent on the configuration of the heater array, a heating zone or group may have different (approximate) shapes. The shape of a heating zone may be, but is not limited to a point, line, curved line, two or more crossed lines, helix, full or outline square, rectangle, circle, triangle, octagon, and star. Depending on the initial shape of the heating zone and heater array configuration, the propagation of the heating zone may be, but is not limited to a linear, radial, angular, extending, shrinking movement.

In one or more preferred programs, two or more adjacent heating zones or groups are activated, or energized, to deliver heat to the aerosol-generating article with overlapping timings. Subsequent zones may be activated, or energized, to deliver heat to the aerosol-generating article before the end of the heating cycle of a previous zone in order to pre-heat the subsequent portion of the aerosol-generating article and maintain a consistent aerosol generation throughout the entire experience. Additionally, the heating cycle for each zone may consist of multiple phases with different temperature profiles in order to optimize the pre-heating, aerosol creating and cool down process.

The user may, or can, determine a tradeoff between the aerosol density and the duration of the experience. The user choice is translated in the area of the active heating zone or group. A larger total heating zone or group will result in a denser aerosol, but also consume the material faster, shortening the length of the experience.

At least two heating zones or groups may be active at the same time, operating at different temperatures at different locations, in order to release different volatiles. This enables influencing the composition of the aerosol and change the composition of the aerosol over the duration of the user experience.

The aerosol-generating article may be identified, and the aerosol-generating device may adjust how the heater array is used to heat the aerosol-generating article based on such identification. For example, preferably, the controller may be configured to identify at least one property of the aerosol-generating article. The at least one property of the aerosol-generating article may include one or more of the size, shape, type, density, content, age, and brand of the aerosol-generating article. Based one or more of the at least one property of the aerosol-generating article, the aerosol-generating device may heat the aerosol-generating article accordingly. For example, the aerosol-generating device may adjust or configure the heater array based on the at least one identified property of the aerosol-generating article. For instance, in one aspect, the controller is configured to heat the aerosol-generating article using a selected group or zone of heating elements based on the identified at least one property, such as, e.g., size and shape, of the aerosol-generating article. In another aspect, the controller is configured to heat the aerosol-generating article using a selected zone of heating elements based on the type of the aerosol-generating article. In another aspect, each group of the plurality of groups may heat an aerosol-generating article individually or at the same time as other heating elements based on the identified at least one property of the aerosol-generating article. In another aspect, each of the plurality of heating elements may heat an aerosol-generating article individually or at the same time as other heating elements using a time-division pulse drive based on an identified at least one property of the aerosol-generating article. Thus, different groups or zones of heating elements may heat an aerosol-generating article in a particular pattern or process based on the at least one identified property of the aerosol-generating article, which may result in efficient and effective aerosol production.

Thus, in one or more illustrative embodiments, the heating zone or group may be adjusted to the size, shape, or another property of the aerosol-generating article or consumable. Adjustment may be done either by user input or identification by a sensor. This sensor may be, but not limited to an optical sensor, infrared sensor, capacitive sensor, and radiofrequency identification (RFID) sensor. Adjustment of the heating zone to the aerosol-generating article enables the use of different sizes or shapes of aerosol-generating articles while maintaining energy efficiency and optimal aerosol generation.

In one or more illustrative embodiments, the heating temperature and program is adjusted to the type or another property of the aerosol-generating article. Adjustment may be done either by user input or identification of the at least one property of an aerosol-generating article, for example, by a sensor. This sensor may be, but not limited to an optical sensor, infrared sensor, capacitive sensor, and RFID sensor. Adjustment of the heating temperature and program to the consumable enables the use of different types of aerosol-generating articles while maintaining optimal aerosol generation for each type of aerosol-generating article.

In one or more illustrative embodiments, not all heating elements are in contact with the aerosol-generating article are activated during the entire heating program. This means sections of the aerosol-generating article may be left unheated, and therefore, not consumed. In one or more illustrative embodiments, at least one heating element of heating zone is activated more than once during the entire heating program. This means an already consumed section of the aerosol-generating article may be heated again, which may cause unwanted volatiles to be released.

All scientific and technical terms used herein have meanings commonly used in the art unless otherwise specified. The definitions provided herein are to facilitate understanding of certain terms used frequently herein. As used herein, the singular forms "a", "an", and "the" encompass embodiments having plural referents, unless the content clearly dictates otherwise. As used herein, "or" is generally employed in its sense including "and/or" unless the content clearly dictates otherwise. As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like. The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Reference will now be made to the drawings, which depict one or more aspects described in this disclosure. However, it will be understood that other aspects not depicted in the drawing fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components.

Figure 6:
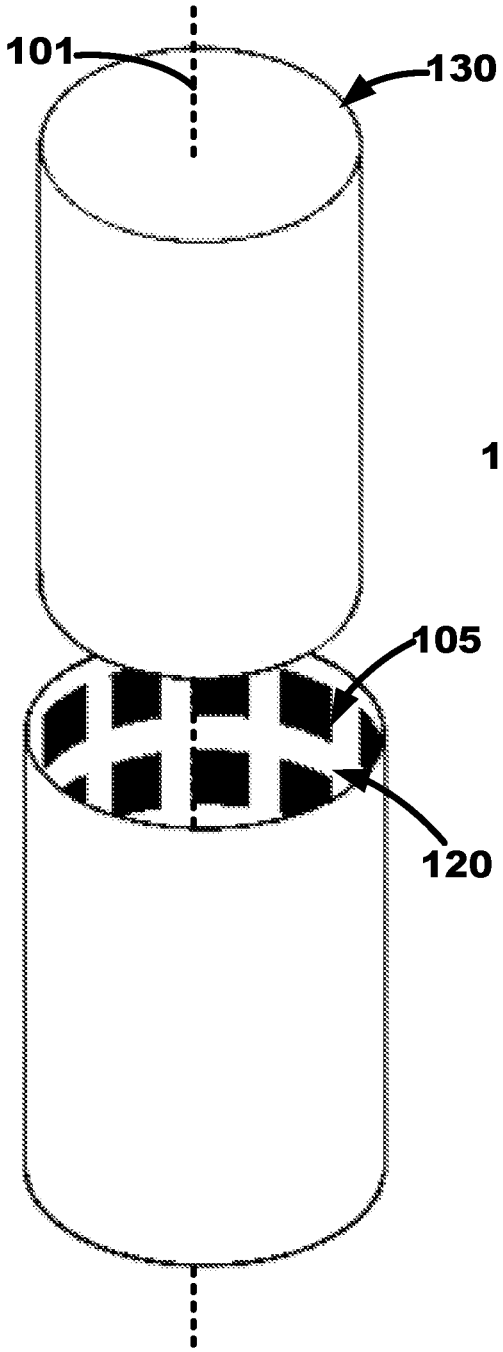

FIG. 6 is a perspective view an illustrative tubular cavity 105 including a heater array 120 and an aerosol-generating article 130.

Figure 7:
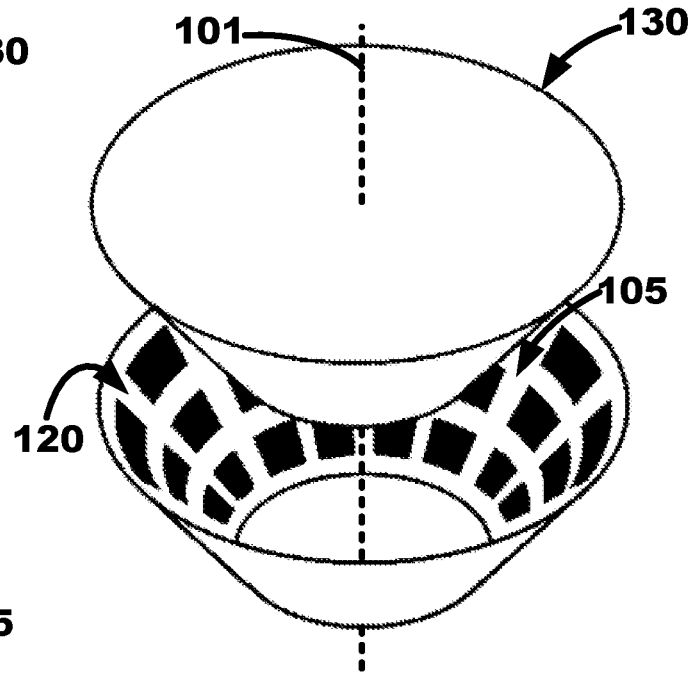

FIG. 7 is a perspective view an illustrative truncated conical cavity 105 including a heater array 120 positioned on an inner surface and an aerosol-generating article 130.

Figure 8:
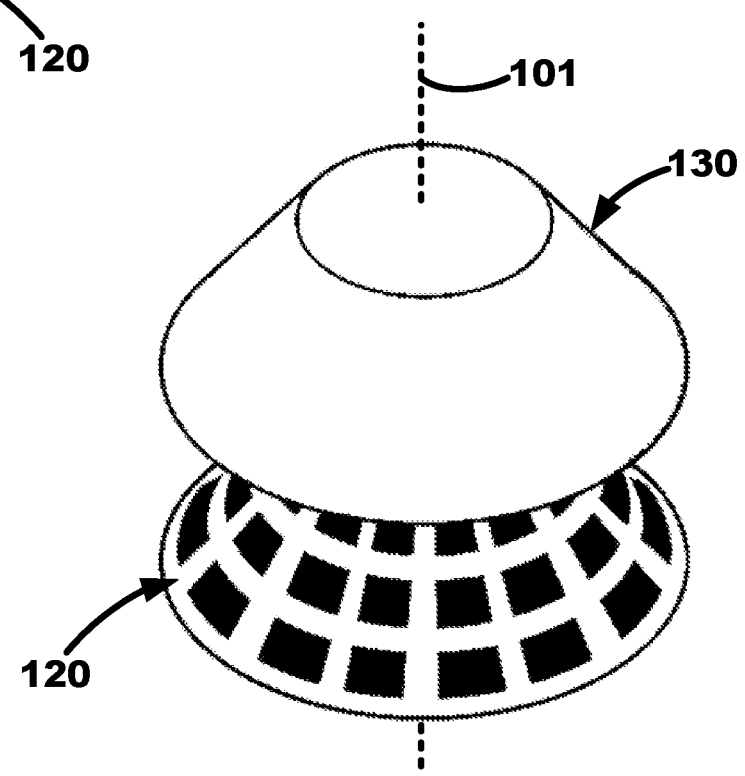

FIG. 8 is a perspective view an illustrative truncated conical cavity 105 including a heater array 120 positioned on an outer surface and an aerosol-generating article 130.

Figure 9:
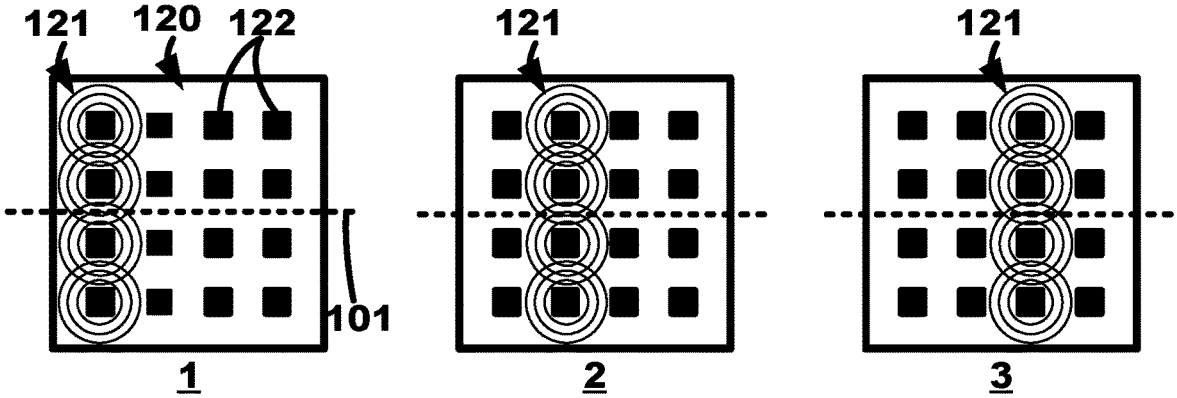

FIG. 9 is a schematic diagram of an illustrative heating propagation pattern on a heater array 120.

Figure 10:
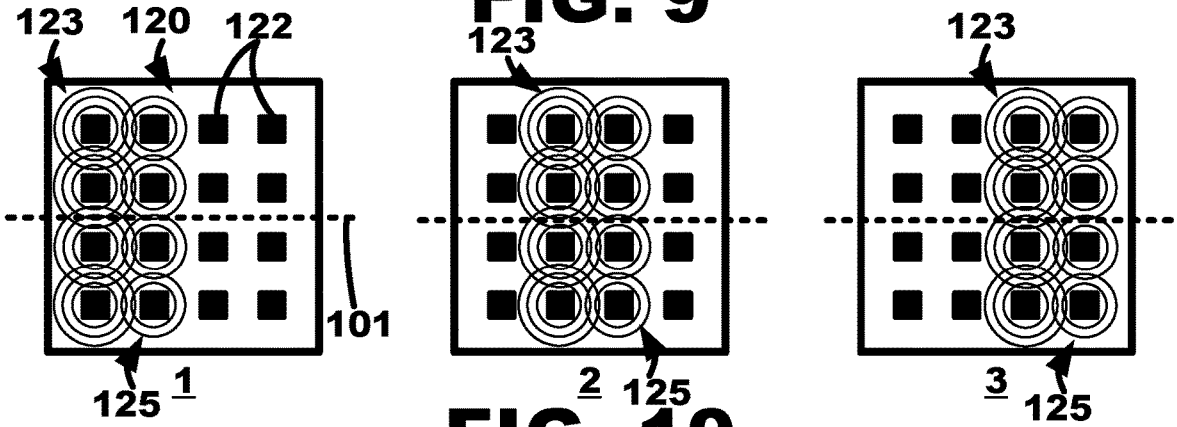

FIG. 10 is a schematic diagram of another illustrative heating propagation pattern on a heater array 120.

Figure 11:
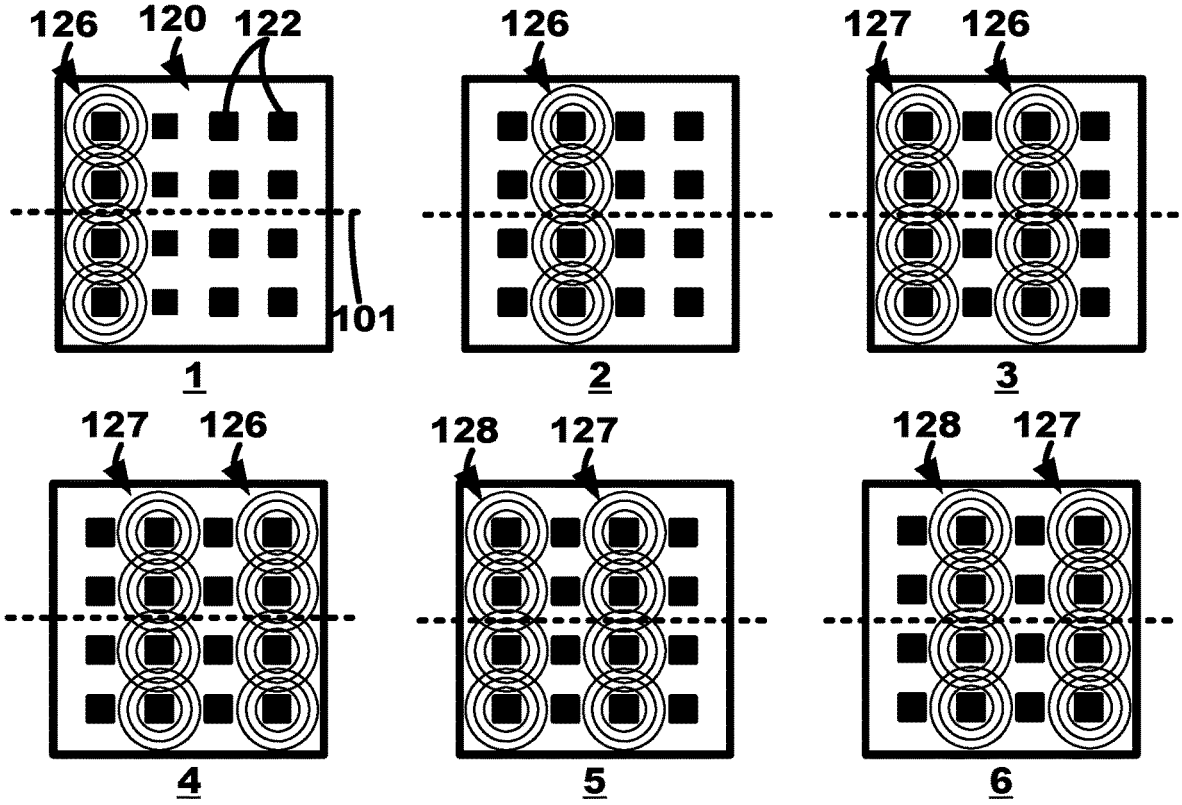

FIG. 11 is a schematic diagram of another illustrative heating propagation pattern on a heater array 120.

Figure 12:
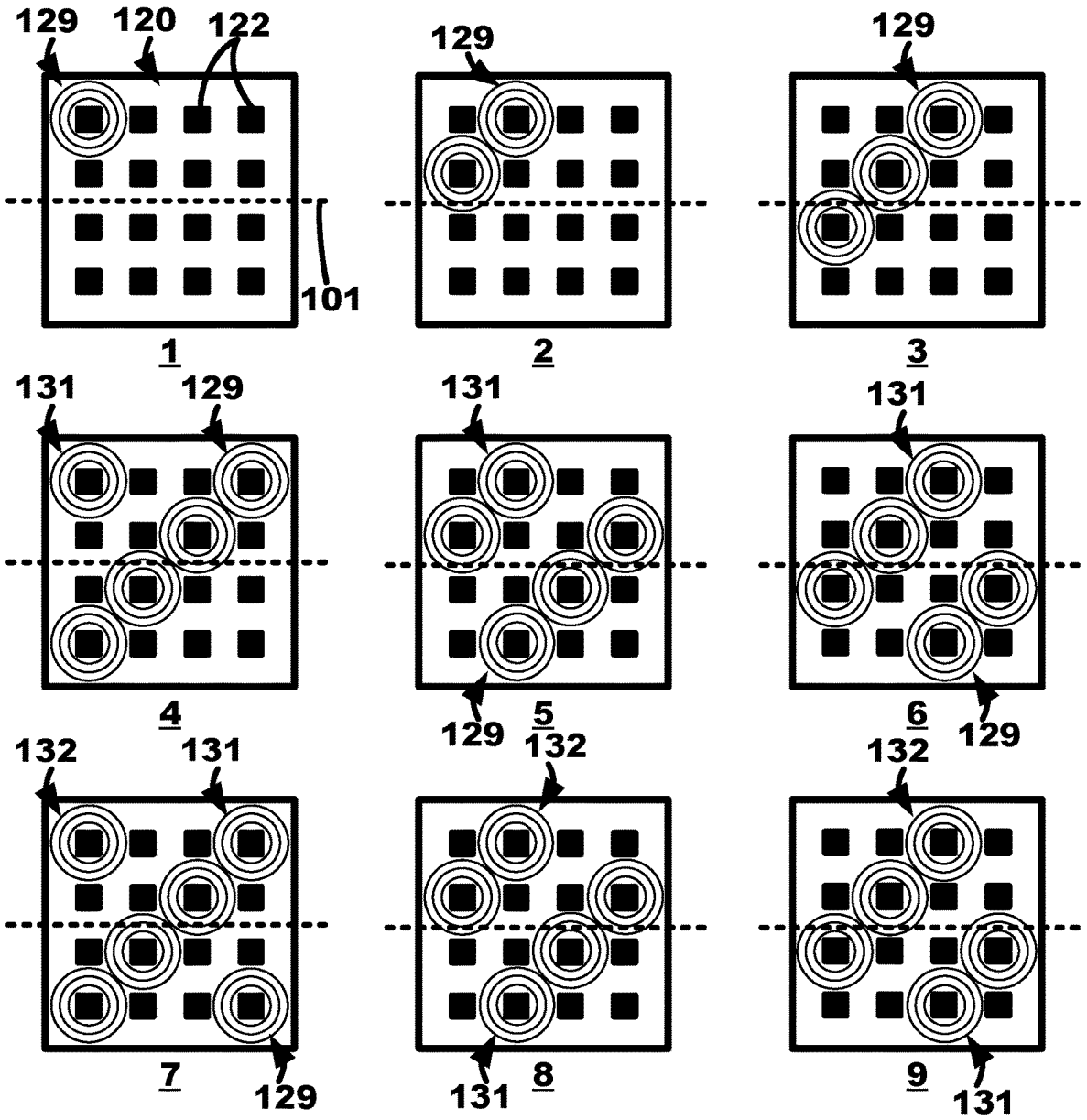

FIG. 12 is a schematic diagram of another illustrative heating propagation pattern on a heater array 120.

Figure 13:
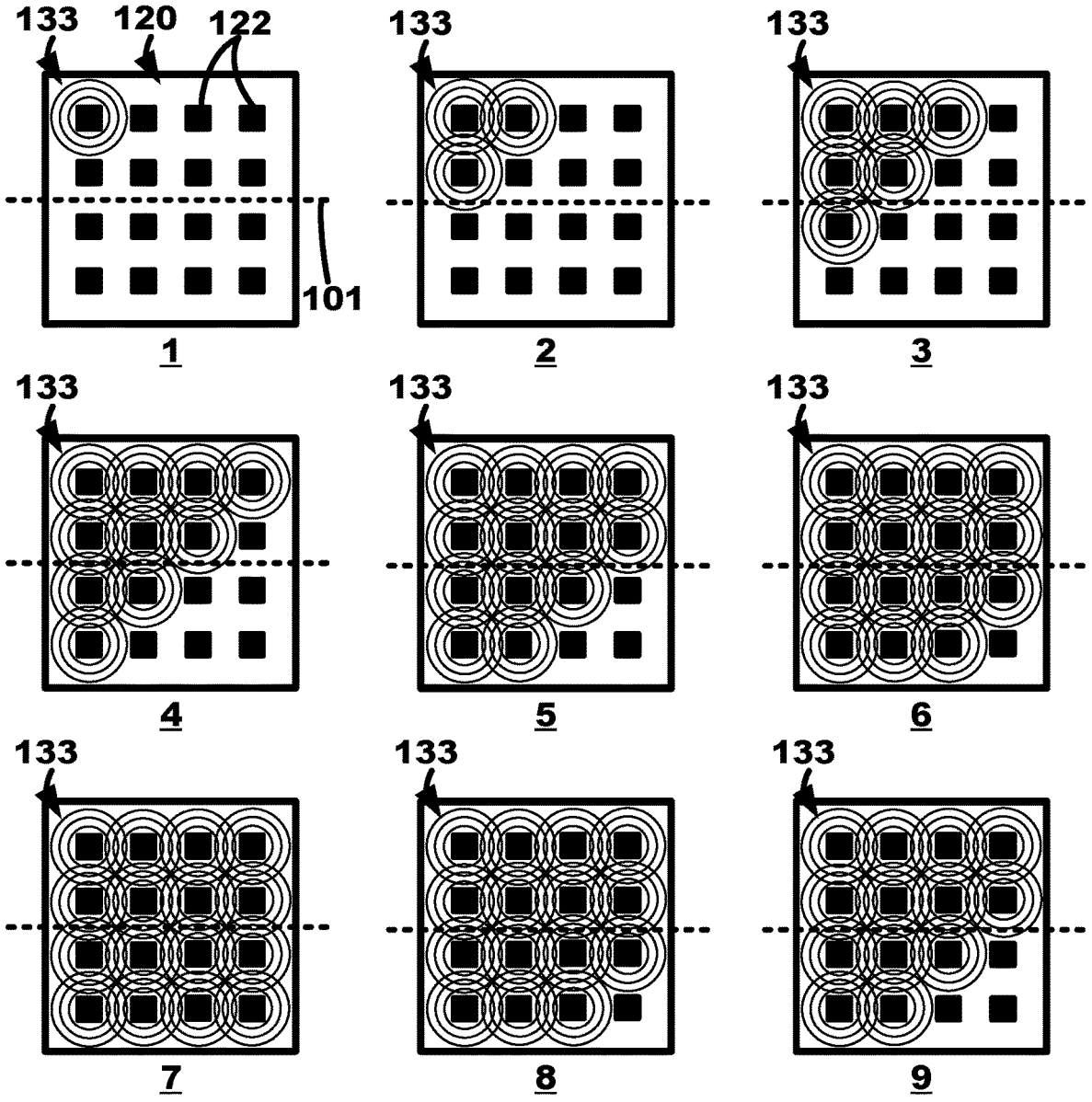

FIG. 13 is a schematic diagram of another illustrative heating propagation pattern on a heater array 120.

Figure 14:
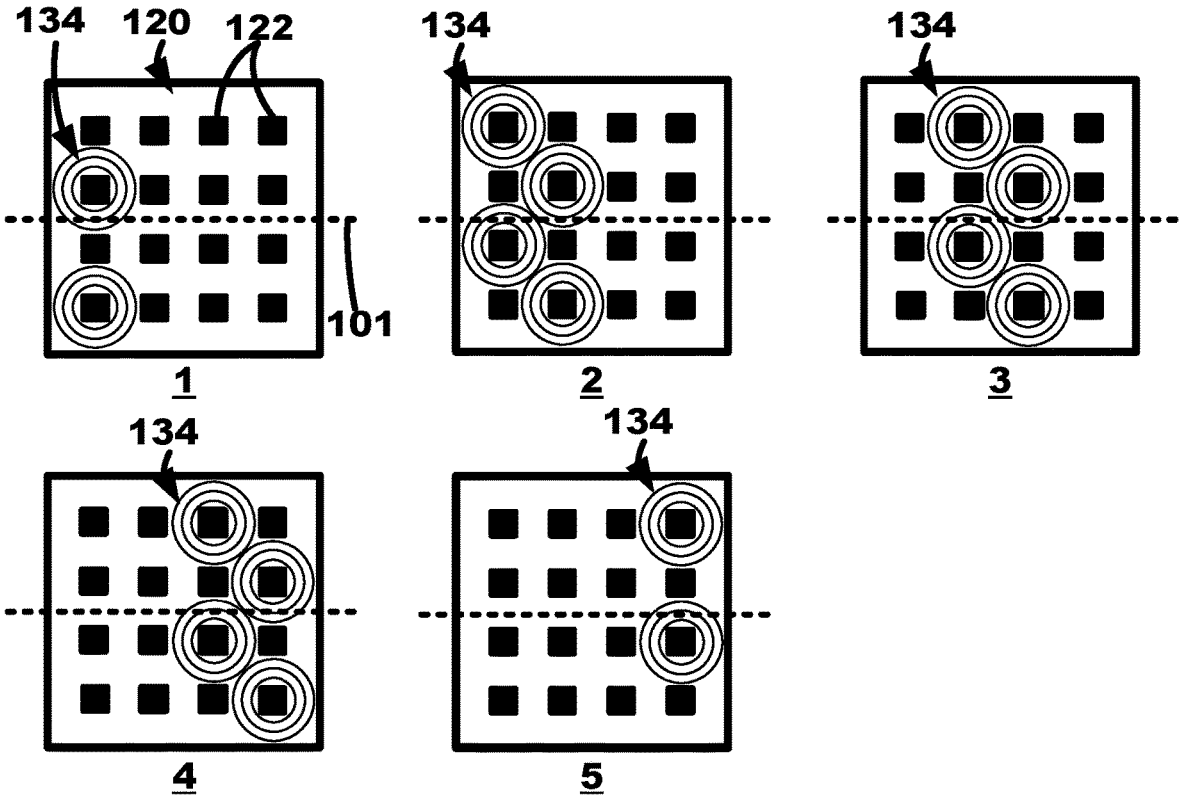

FIG. 14 is a schematic diagram of another illustrative heating propagation pattern on a heater array 120.

Figure 15:
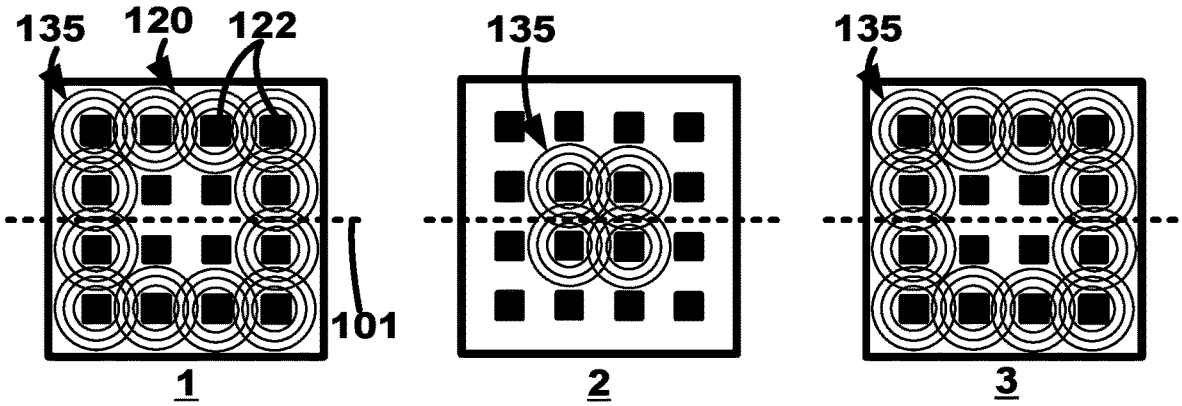

FIG. 15 is a schematic diagram of another illustrative heating propagation pattern on a heater array 120.

Figure 16:
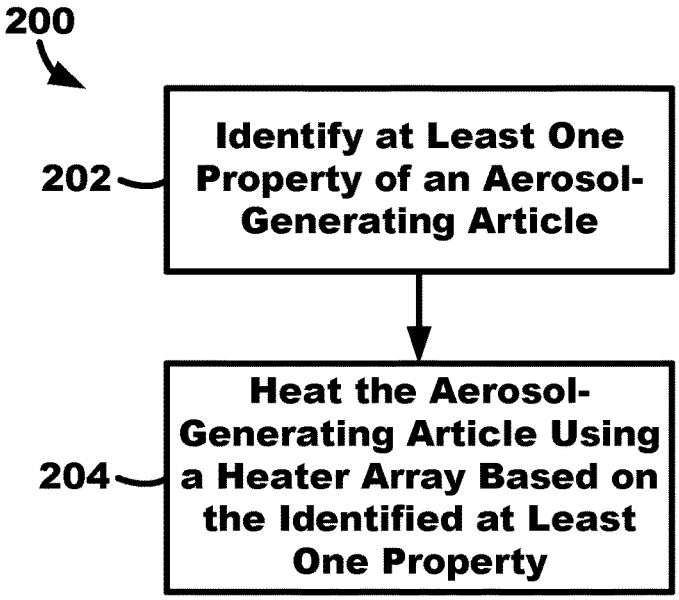

FIG. 16 is a schematic diagram of illustrative method of controlling a heater array.

As shown, an illustrative aerosol-generating device 100 may include a housing 110. In this illustrative embodiment of FIGS. 1-2, the housing 110 may extend form a distal end 107 to a proximal end 108. The housing 110 may include, or define, a cavity 105 for receiving an aerosol-generating article 130 and may be sized and shaped accordingly. For example, the cavity 105 of device 100 of FIGS. 1-2 defines a rectangular, or box-like, cavity 105 for receiving a substantially thin, rectangular aerosol-generating article 130.

Other cavities that may be used with illustrative aerosol-generating device 100 are depicted in FIGS. 6-8. As shown in FIG. 6, the cavity 105 is a tube for receiving a cylindrical aerosol-generating element 130. As shown in FIGS. 7-8, the cavity 105 is a truncated cone for receiving a truncated cone-shaped aerosol-generating element 130.

Figure 1:
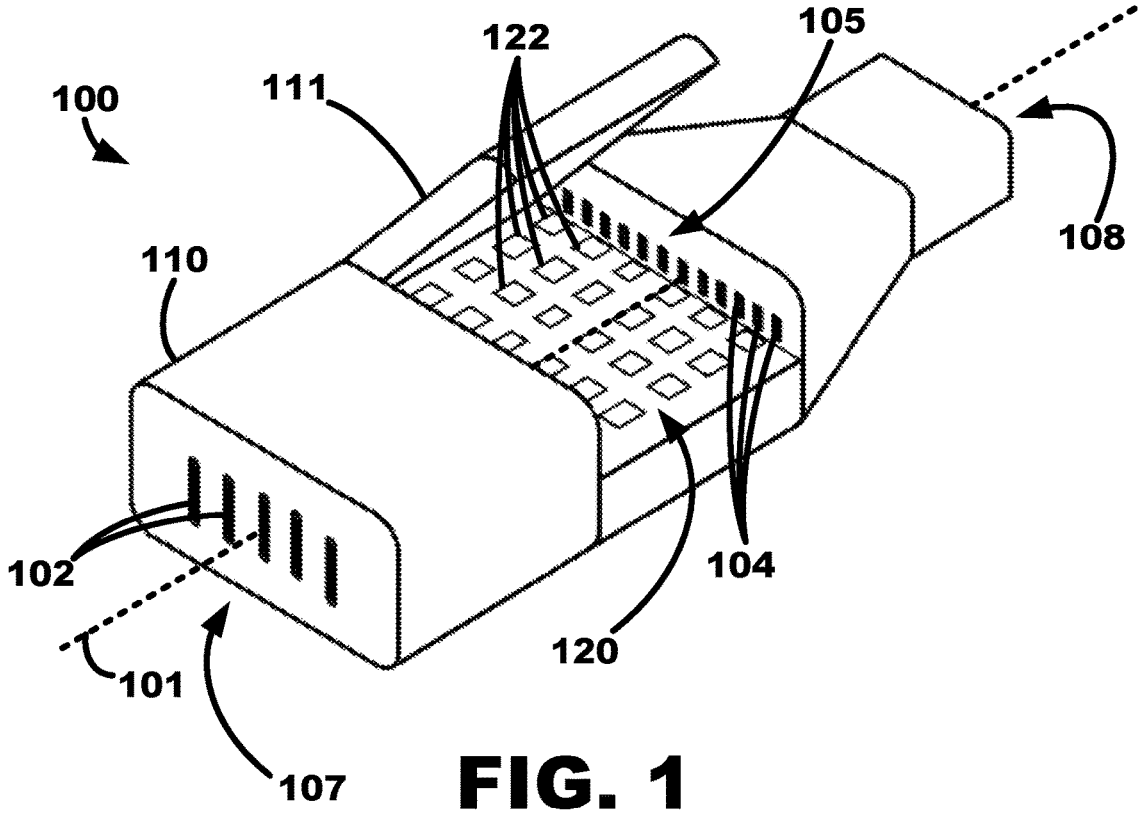
FIG. 1 is a perspective view of an illustrative aerosol-generating device 100.

No matter the shape of the cavity 130 of the aerosol-generating device 100, the cavity 130 may be aligned along a cavity axis 101. The housing 110 may include one or more inlets 102 that extend from outside of the cavity 130 to inside of the cavity for the ingress of air and one or more outlets 104 that extend from outside of the cavity 130 to inside of the cavity for discharge of air. In this way, a user may inhale from the proximal end 108 of the aerosol-generating device 100 to draw airflow form the one or more inlets 102 through the cavity 130 proximate, across, or through the aerosol-generating article 130, and out the outlets 104 to deliver aerosol to the user. For example, the airflow path is designated by arrows 119 shown in FIG. 2. In one or more illustrative embodiments such as shown in FIGS. 1-2, the airflow path may extend substantially along the cavity axis 101.

The housing 110 of the aerosol-generating device 100 may further include a hinged door 111 that may capture, or enclose, an aerosol-generating article 130 within the cavity 105. In other words, an aerosol-generating article 130 may be sandwiched within the housing 110 between two planar surfaces, one of the surfaces being defined by the hinged door 111.

The illustrative aerosol-generating device 100 further includes one or more heater arrays 120. As shown in FIG. 1, the heater array 120 includes a plurality of heating elements 122 positioned in a plurality of rows and columns on a planar surface of the housing 110 within the cavity 130 of the aerosol-generating device 100. Thus, the hinged door 111 may swing down over the top of an aerosol-generating article positioned in the cavity 105 to position the aerosol-generating article proximate the heater array 120 comprising the plurality of heating elements on the planar surface of the housing 110.

Figure 2:
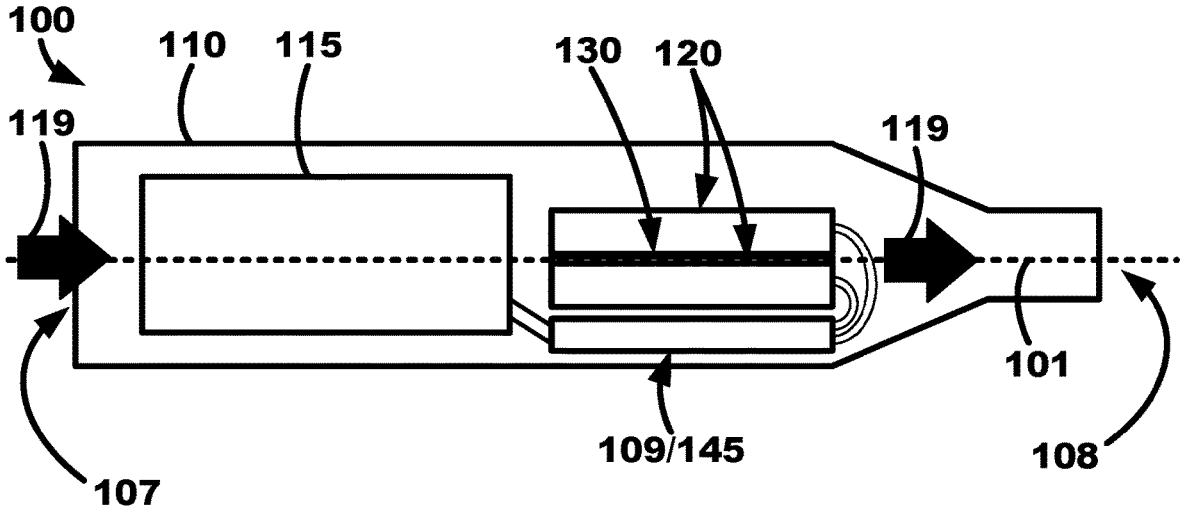
FIG. 2 is a schematic sectional view of the aerosol-generating device 100 of FIG. 1.

The illustrative aerosol-generating device 100 of FIG. 2 includes two heater arrays 120 positioned facing each other such that the aerosol-generating article is "sandwiched" therebetween. Each of the heater arrays 120 are operatively coupled to a heating circuitry 145 and controller 109, which is operatively coupled to a battery 115. In one illustrative embodiment, one of the two heater arrays 120 may be part of, or positioned on, the hinged door 111 of the housing 110.

Figure 3:
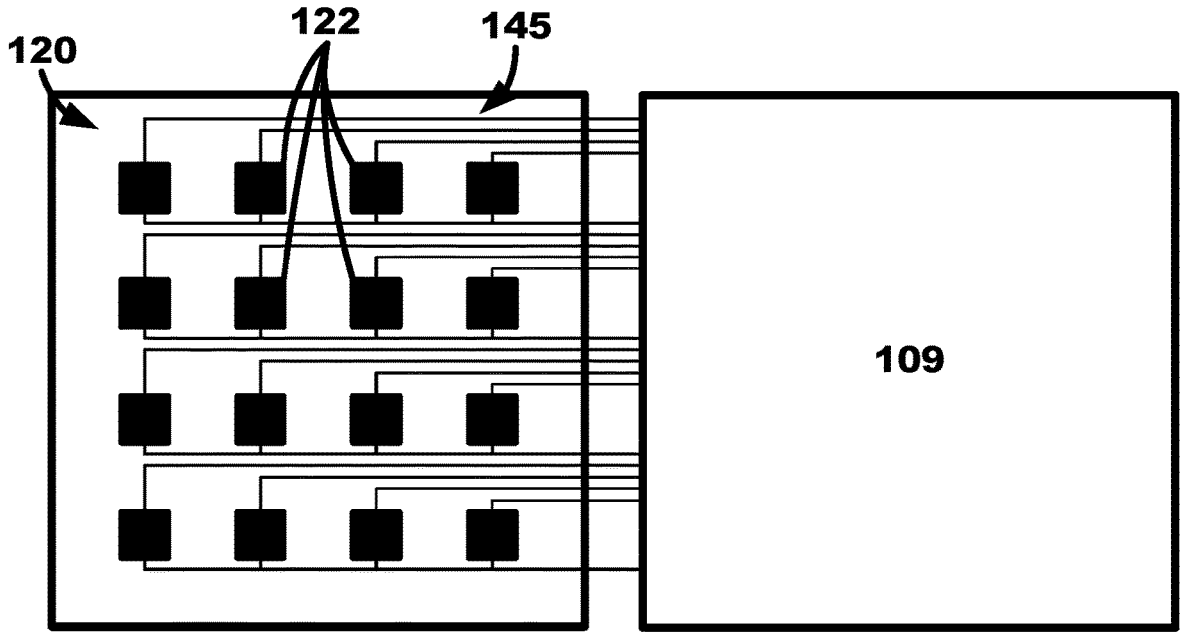
FIG. 3 is a schematic view of an illustrative heater array 120 and heating circuitry 145.
Figure 4:
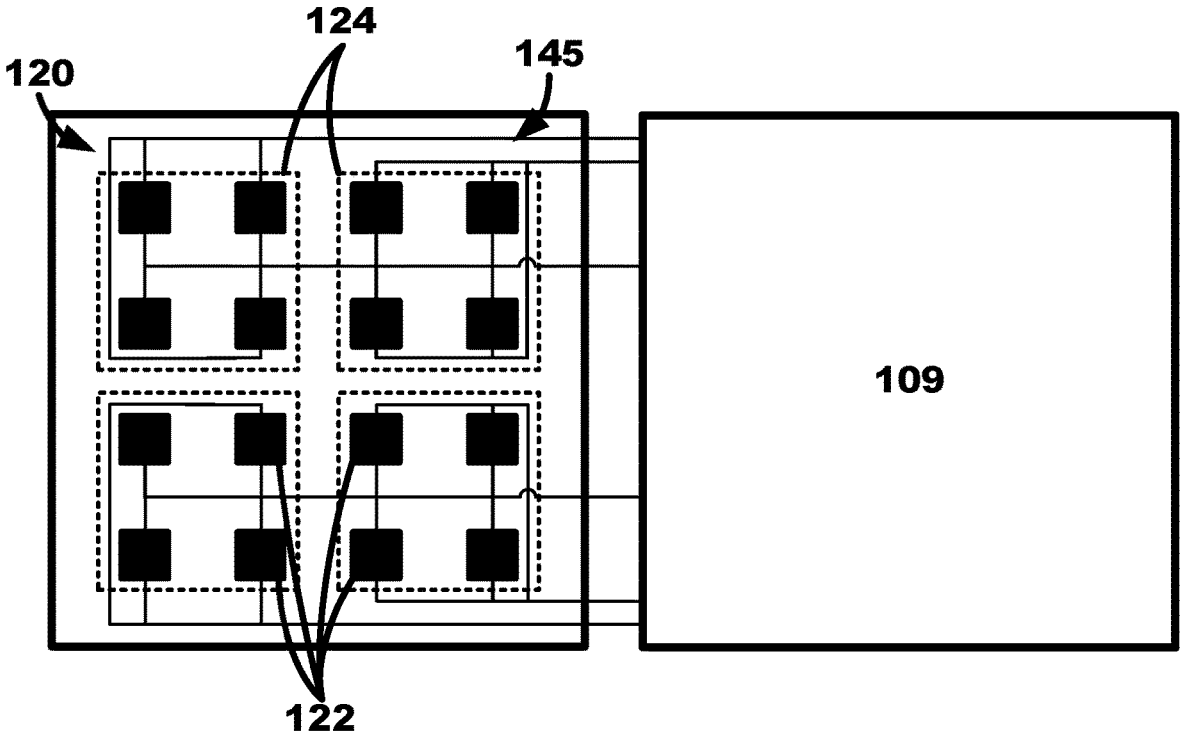
FIG. 4 is a schematic view of another illustrative heater array 120 and heating circuitry 145.
Figure 5:
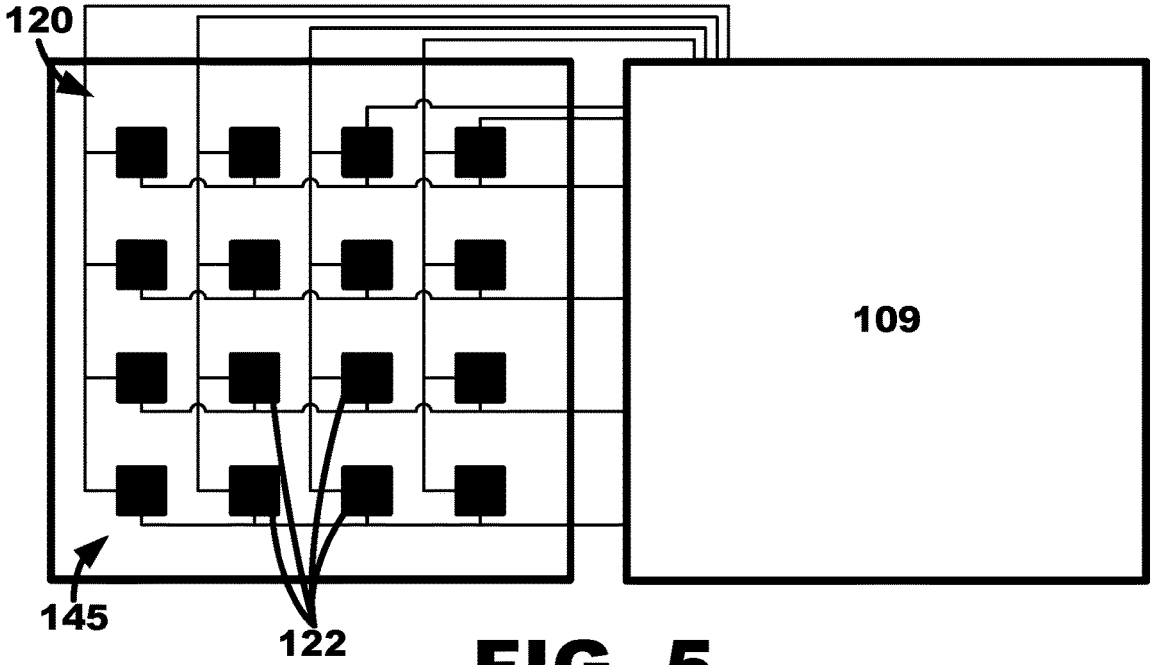
FIG. 5 is a schematic view of still another illustrative heater array 120 and heating circuitry 145.

Schematic views of various illustrative heater arrays 120, heating circuitry 145, and a controller 109 are depicted in FIGS. 3-5. The configuration of FIG. 3 includes heating circuitry 145 that enables individual control of each of the heating elements 122. Thus, the controller 109 may be able to control each of the heating elements 122 individually to deliver heat to an aerosol-generating article. Each heating element 122 may include a dedicated circuit or wire extending to the controller 109 operatively coupling the heating element 122 thereto. Additionally, more than one heating element 122 may share the same ground wire or circuit despite being individually controlled. More specifically and in other words, each heating element 122 in the array 120 is individually wired to a controller, or driver, 109 to control the state of the heating element 122, effectively creating individual electrical circuits 145. The heating elements 122 may either have individual ground wires or multiple heating elements may share a common ground.

The configuration of FIG. 4 includes heating circuitry 145 that enables group control of the heating elements 122. As shown, the heating elements 122 are organized into four groups 124 of heating elements 122 (each group 124 outlined with a dashed line). The heating circuitry 145 operatively couples each of the groups 124 to the controller 109 such that the controller may energize all of the heating elements 122 of a group 124 or multiple groups 124 at the same time. More specifically and in other words, the heating elements 122 may be divided into at least two groups 124 of heating elements 122. Each group 124 of heating elements 122 is wired to a controller, or driver, 109 to control the group 124. Within these groups 124, heating elements 122 may be connected either in parallel or in series. Either each group 124 may have an individual ground wire or multiple groups 124 may share a common ground.

The configuration of FIG. 5 includes heating circuitry 145 that enables control each of the heating elements 122 through various time-based schemes or processes. For example, all heating elements 122 are arranged and wired in a matrix format. To control the heating elements 122 in the array 120, a voltage is applied at the intersections of specific vertical signal electrodes and specific horizontal scanning electrodes. In this method, several heating elements 122 may be activated at the same time by time-division in a pulse drive (which may also be referred to as a multiplex, or dynamic, drive method). In order to control the temperature for the individual or groups of heating elements 122, the voltage applied to the circuits 145 may be controlled or a constant voltage may be applied with a controllable interval (this method is called pulse width modulation).

Schematic diagrams of illustrative heating propagation programs on a heater array 120 are depicted in FIGS. 9-10. The programs are shown in a time sequence from left to right in three frames. As shown in the first frame of FIG. 9, the zone or group 121 of activated heating elements 122 is a line or row of four heating elements 122 orthogonal to the cavity axis 101. In the second frame, the zone of activated heating elements 122 orthogonal to the cavity axis 101 has shifted to right, one row away from the zone of activated heating elements 122 of the first frame. In other words, the zone of activated heating elements 122 has shifted linearly along the axis 101. The linear shift could occur towards a proximal end or distal end of the axis 101, depending on the program. When the zone of activated heating elements 122 shifted to the right in frame 2, the initial zone of activated heating elements 122 may be deactivated. Furthermore, the zone of activated heating elements 122 shifts again in frame 3, while the previous zone of activated heating elements 122 of frame 2 are deactivated. This program may continue shifting along the array 120 along the axis 101 until all of the zones of activated heating elements 122 have been activated.

The program depicted in FIG. 10 activates two groups, or zones, at the same time but using different temperatures or energies. As shown in the first frame of FIG. 10, a first zone, or group, 123 of activated heating elements 122 is a row of four heating elements 122 orthogonal to the cavity axis 101 and energized at a higher temperature or energy while a second zone, or group, 125 of activated heating elements 122 is a row of four heating elements 122 orthogonal to the cavity axis 101 and energized at a lower temperature or energy (i.e., lower than the first zone 123). Similar to the program depicted in FIG. 9, the zones may shift to the right. In the second frame, the zones 123, 125 of activated heating elements 122 has shifted to right by one row. The previous row of heating elements 122 that was considered the second zone 125 is now the first zone 123, and the second zone 125 is covering a new row of heating elements 122. In other words, the zones 123, 125 of activated heating elements 122 has shifted linearly along the axis 101. This program may continue shifting along the array 120 along the axis 101 until all of the zones of activated heating elements 122 have been activated. In other words, at least two heating zones are active at the same time, operating at different temperatures at different locations, in order to release different volatiles, which may enable influencing the composition of the aerosol and change the composition of the aerosol over the duration of the user experience.

The program depicted in FIG. 11 activates two groups, or zones, at the same time that move, or sweep, across the array 120. Each of the two groups, or zones, are vertical lines. As shown in the first frame of FIG. 11, a first zone, or group, 126 of activated heating elements 122 is a row of four heating elements 122 orthogonal to the cavity axis 101. The zone 126 may shift to the right as shown in the second and third frames. In the third frame, a new zone 127 spaced one row over from zone 126 enters on the left side of the array 120 and subsequently moves along the cavity axis 101 in similar fashion and timing as zone 126. In the fourth frame, the zones 126, 127 have shifted to right by one row. In the fifth frame, the first zone 126 has moved off the array, and a new zone 128 has begun on the left side of the array spaced one row away from zone 127, and such zones 127, 128 may continue to move along the cavity axis 101 as shown in the sixth frame.

The program depicted in FIG. 12 is similar to that of FIG. 11 in that zones defining lines of heating elements 122 are spaced apart and are swept across the array 120. In the example of FIG. 12, the zones 129, 131, 132 move from a first corner of the array 120 to an opposite corner of the array 120. For example, the first zone 129 starts in the upper left corner in the first frame and moves towards to the lower right corner in subsequent frames. When the first zone 129 reaches two rows, or lines, away from the upper left corner as shown in the fourth frame, the second zone 131 may start in the upper left corner and proceed in the same direction and manner as the first zone 129. When the first zone 129 reaches the lower right corner as shown in the seventh frame, the second zone 131 is located two rows, or lines, away from the upper left corner, and as such, a third zone 132 is introduced in the upper left corner that propagates in the same way as the first and second zones 129, 131.

The program depicted in FIG. 13 activates a single group, or zone, 133 that expands, or grows, from a corner of the array 122 until reaching the opposing corner in the seventh frame upon which the zone 133 begins to shrink back to the corner where it started. The program depicted in FIG. 14 activates a zig-zag zone 134 that moves from left to right across the array 120 along the cavity axis 101. The program depicted in FIG. 15 activates a perimeter zone 135 that extends about the perimeter of the array 120 as shown in the first frame, and subsequently contracts to the middle as shown in the second frame and expands back to the perimeter in the 3rd frame.

An illustrative method 200 of controlling a heater array of an aerosol-generating device is depicted in FIG. 16. The method 200 may include identifying at least one property of an aerosol-generating article 202. The at least one property may include type, size, shapes, content, age, brand, density, and any other properties of aerosol-generating articles. In one aspect, an aerosol-generating device may be configured to detect an aerosol-generating article when the aerosol-generating article is operably coupled to aerosol-generating device. For example, the aerosol-generating device may include a sensor that identifies the aerosol-generating article. The aerosol-generating device may include data storage that includes, or stores, a plurality of properties of the aerosol-generating articles, and upon identification of the aerosol-generating article, the aerosol-generating device may identify the properties that match the identified aerosol-generating article.

The method 200 may further include heating the aerosol-generating article using the illustrative heater array based on the identified at least one property 204. For example, various aspects of the heater array and heater program may change based the identified at least one property. For instance, the propagation pattern and heat values may change depending on the identified at least one property of the aerosol-generating article.

Thus, illustrative devices and methods using a heater array are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the electrical arts, computer arts and aerosol-generating device manufacturing or related fields are intended to be within the scope of the following claims.

The invention claimed is:

1. An aerosol-generating device comprising:

a housing defining a cavity to receive an aerosol-generating article and extending along a cavity axis;

a heater array coupled to the housing and comprising a plurality of heating elements operable to heat an aerosol-generating article positioned within the cavity, and a controller comprising one or more processors and operably coupled to the heater array to select which of the plurality of heating elements to heat the aerosol-generating article positioned in the cavity, wherein the controller is configured to:

identify at least one property of the aerosol-generating article, the at least one property of the aerosol-generating article comprising at least one of size, shape, type, content, age, and brand; and heat the aerosol-generating article using a selected zone of heating elements based on the identified at least one property of the aerosol-generating article.

2. The aerosol-generating device as in claim 1, wherein two or more heating elements of the plurality of heating elements are positioned within a plane orthogonal to the cavity axis, and wherein two or more heating elements of the plurality of heating elements are positioned in different positions along the cavity axis so as to not lie in a plane orthogonal to the cavity axis.

3. The aerosol-generating device as in claim 1, wherein the housing further defines at least one inlet extending into the cavity to intake air and at least one outlet extending into the cavity to discharge air, wherein an airflow path from the at least one inlet to the at least one outlet extends along the cavity axis.

4. The aerosol-generating device as in claim 1, further comprising a sensor to identify the aerosol-generating article to provide the identified at least one property of the identified aerosol-generating article, wherein the sensor comprises at least one of an optical sensor, an infrared sensor, a capacitive sensor, and a radiofrequency identification (RFID) sensor.

5. The aerosol-generating device as in claim 1, further comprising heating circuitry operably coupled to the heater array to provide a plurality of groups of heating elements to allow each group of the plurality of groups to heat an aerosol-generating article individually or at the same time as other heating elements based on the identified at least one property of the aerosol-generating article, wherein each heating element of each group heats an aerosol-generating article at the same time as other heating elements of the group.

6. The aerosol-generating device as in claim 1, wherein the cavity is a tube, cone, or truncated cone extending along the cavity axis and defining a cylindrical or conical inner or outer surface, wherein the plurality of heating elements are positioned on the cylindrical or conical inner or outer surface to heat an aerosol-generating article positioned within the cavity, wherein the two or more heating elements of the plurality of heating elements positioned within a plane orthogonal to the cavity axis are positioned circumferentially about the cylindrical or conical inner or outer surface.

7. The aerosol-generating device as in claim 1, wherein the plurality of heating elements are arranged in a plurality of rows of heating elements, wherein each row of heating elements comprises two or more heating elements, wherein the two or more heating elements of each row are positioned within a plane orthogonal to the cavity axis that is different from the other rows, wherein the controller is further configured to:

heat the aerosol-generating article using the two or more heating elements of only one row at the same time until each of the plurality of rows has heated the aerosol-generating article based on the identified at least one property of the aerosol-generating article.

8. The aerosol-generating device as in claim 1, wherein the plurality of heating elements are arranged in a plurality of rows of heating elements, wherein each row of heating elements comprises two or more heating elements, wherein the two or more heating elements of each row are positioned within a plane orthogonal to the cavity axis that is different from the other rows, wherein the controller is further configured to:

heat the aerosol-generating article using at least two or more heating elements of only two rows at the same time until each of the plurality of rows has heated the aerosol-generating article based on the identified at least one property of the aerosol-generating article.

9. The aerosol-generating device as in claim 8, wherein the temperature of a first row of the two rows is greater than the temperature of the second row of the two rows when heating the aerosol-generating article at the same time.

10. The aerosol-generating device as in claim 1, wherein the controller is further configured to:

initially heat the aerosol-generating article using a first number of heating elements of the plurality of heating elements based on the identified at least one property of the aerosol- generating article; and subsequently heat the aerosol-generating article using a second number of heating elements of the plurality of heating elements based on the identified at least one property of the aerosol-generating article, wherein the second number is greater than the first number.

11. The aerosol-generating device as in claim 1, wherein the plurality of heating elements are arranged in a grid defining a plurality of rows of heating elements and a plurality of columns of heating elements, wherein the heating elements of each row are positioned within a plane orthogonal to the cavity axis that is different from the other rows, wherein the heating elements of each different column are positioned along a different axis parallel to the cavity axis.

12. The aerosol-generating device as in claim 11, wherein the controller is further configured to:

heat the aerosol-generating article using a selected zone of heating elements, wherein the selected zone defines one or more of a line, curved line, crossed lines, a helix, a square, a perimeter of a square, a rectangle, a circle, a triangle, an octagon, and a star about the grid based on the identified at least one property of the aerosol-generating article.

13. The aerosol-generating device as in claim 1, wherein the controller is further configured to:

heat the aerosol-generating article according a propagation pattern using selected heating elements, wherein the propagation pattern comprises one or more of linear movement, radial movement, angular movement, extending movement, and shrinking movement about the grid based on the identified at least one property of the aerosol-generating article.

14. A method of heating an aerosol-generating article comprising:

positioning an aerosol-generating article within a cavity of a housing extending along a cavity axis;

identifying at least one property of the aerosol-generating article positioned within the cavity, the at least one property of the aerosol-generating article comprising at least one of size, shape, type, content, age, and brand; and heating the aerosol-generating article using a selected zone of heating elements included in a heater array disposed in the cavity based on the identified at least one property of the aerosol-generating article, wherein the heater array comprises a plurality of heating elements operable to heat an aerosol-generating article positioned within the cavity.

15. The method as in claim 14, wherein two or more heating elements of the plurality of heating elements are positioned within a plane orthogonal to the cavity axis, and wherein two or more heating elements of the plurality of heating elements are positioned in different positions along the cavity axis so as to not lie in a plane orthogonal to the cavity axis.

16. The method as in claim 14, wherein the housing further defines at least one inlet extending into the cavity to intake air and at least one outlet extending into the cavity to discharge air, wherein an airflow path from the at least one inlet to the at least one outlet extends along the cavity axis.

17. The method as in claim 14, wherein identifying at least one property of the aerosol-generating article positioned within the cavity comprises using a sensor to identify the aerosol-generating article to provide the identified at least one property of the identified aerosol-generating article, wherein the sensor comprises at least one of an optical sensor, an infrared sensor, a capacitive sensor, and a radiofrequency identification (RFID) sensor.

18. The method as in claim 14, wherein the heater array provides a plurality of groups of heating elements to allow each group of the plurality of groups to heat an aerosol-generating article individually or at the same time as other heating elements based on the identified at least one property of the aerosol-generating article, wherein each heating element of each group heats an aerosol-generating article at the same time as other heating elements of the group.

19. The method as in claim 14, wherein the cavity is a tube, cone, or truncated cone extending along the cavity axis and defining a cylindrical or conical inner or outer surface, wherein the plurality of heating elements are positioned on the cylindrical or conical inner or outer surface to heat an aerosol-generating article positioned within the cavity, wherein the two or more heating elements of the plurality of heating elements positioned within a plane orthogonal to the cavity axis are positioned circumferentially about the cylindrical or conical inner or outer surface.

20. The method as in claim 14, wherein the plurality of heating elements are arranged in a plurality of rows of heating elements, wherein each row of heating elements comprises two or more heating elements, wherein the two or more heating elements of each row are positioned within a plane orthogonal to the cavity axis that is different from the other rows, wherein heating the aerosol-generating article using the selected zone of heating elements included in the heater array disposed in the cavity based on the identified at least one property of the aerosol-generating article comprises heating the aerosol-generating article using the two or more heating elements of only one row at the same time until each of the plurality of rows has heated the aerosol-generating article based on the identified at least one property of the aerosol-generating article.

21. The method as in claim 14, wherein the plurality of heating elements are arranged in a plurality of rows of heating elements, wherein each row of heating elements comprises two or more heating elements, wherein the two or more heating elements of each row are positioned within a plane orthogonal to the cavity axis that is different from the other rows, wherein heating the aerosol-generating article using the selected zone of heating elements included in the heater array disposed in the cavity based on the identified at least one property of the aerosol-generating article comprises heating the aerosol-generating article using at least two or more heating elements of only two rows at the same time until each of the plurality of rows has heated the aerosol-generating article based on the identified at least one property of the aerosol-generating article.

22. The method as in claim 21, wherein the temperature of a first row of the two rows is greater than the temperature of the second row of the two rows when heating the aerosol-generating article at the same time.

23. The method as in claim 14 further comprising:

initially heating the aerosol-generating article using a first number of heating elements of the plurality of heating elements based on the identified at least one property of the aerosol-generating article; and subsequently heating the aerosol-generating article using a second number of heating elements of the plurality of heating elements based on the identified at least one property of the aerosol-generating article, wherein the second number is greater than the first number.

24. The method as in claim 14, wherein the plurality of heating elements are arranged in a grid defining a plurality of rows of heating elements and a plurality of columns of heating elements, wherein the heating elements of each row are positioned within a plane orthogonal to the cavity axis that is different from the other rows, wherein the heating elements of each different column are positioned along a different axis parallel to the cavity axis.

25. The method as in claim 24, wherein heating the aerosol-generating article using the selected zone of heating elements included in the heater array disposed in the cavity based on the identified at least one property of the aerosol-generating article comprises heating the aerosol-generating article using a selected zone of heating elements, wherein the selected zone defines one or more of a line, curved line, crossed lines, a helix, a square, a perimeter of a square, a rectangle, a circle, a triangle, an octagon, and a star about the grid based on the identified at least one property of the aerosol-generating article.

26. The method as in claim 14, wherein heating the aerosol-generating article using the selected zone of heating elements included in the heater array disposed in the cavity based on the identified at least one property of the aerosol-generating article comprises heating the aerosol-generating article according a propagation pattern using selected heating elements, wherein the propagation pattern comprises one or more of linear movement, radial movement, angular movement, extending movement, and shrinking movement about the grid based on the identified at least one property of the aerosol-generating article.

* * * * *